United States Patent [19]

Makeev et al.

[11] 4,338,879

[45] Jul. 13, 1982

[54] APPARATUS FOR APPLYING ENAMEL SLIP TO PIPE

[76] Inventors: Anatoly E. Makeev, ulitsa Chekhova, 79, kv. 14, Rostov-na-Donu; Alexandr A. Sirotinsky, Fergansky proezd, 13, korpus 1, kv. 15, Moscow, both of U.S.S.R.

[21] Appl. No.: 223,431

[22] Filed: Jan. 18, 1981

[30] Foreign Application Priority Data

Mar. 30, 1978 [SU] U.S.S.R. ..... 2596057

[51] Int. Cl.[3] ..... B05C 3/10

[52] U.S. Cl. ..... 118/602; 118/421; 118/423; 118/425; 118/428; 118/429; 427/435; 118/612; 427/239; 427/345

[58] Field of Search ..... 118/428, 425, 421, 602, 118/612, 423, 429; 264/275; 427/345, 239, 435

[56] References Cited

U.S. PATENT DOCUMENTS

| | | | |
|---|---|---|---|
| 2,048,937 | 7/1936 | Larson | 118/425 |
| 2,342,217 | 2/1944 | Phillips | 118/425 |
| 2,808,344 | 10/1957 | Kaulen et al. | 118/421 |
| 3,087,201 | 4/1963 | Williams et al. | 264/275 |

*Primary Examiner*—Ralph S. Kendall

*Attorney, Agent, or Firm*—McAulay, Fields, Fisher, Goldstein & Nissen

[57] ABSTRACT

Described is apparatus designed for applying enamel slip simultaneously to the internal and external surfaces of a pipe which includes a housing with a rod mounted centrally therein so that a clearance space is formed therebetween. That clearance space measures somewhat more than the thickness of the wall of the pipe under treatment which is to be moved in the clearance space, which is being filled with enamel slip. The clearance space between the housing and the rod measures at least 1.5 times the thickness of the pipe wall.

In one of the embodiments of the invention, the housing and the rod are of cylindrical shape.

The housing is provided with an enamel circulation system which includes a pump communicating with the housing and a reservoir via pipelines. The reservoir is filled with enamel slip and is provided with a thermoregulator.

7 Claims, 3 Drawing Figures

APPARATUS FOR APPLYING ENAMEL SLIP TO PIPE

FIELD OF THE INVENTION

The present invention relates to apparatuses for applying enamel coatings and has particular reference to apparatuses for applying enamel slip to pipes being enameled.

The invention may be used with particular advantage for simultaneously enameling internal and external surfaces of pipes intended for use in underground water supply lines.

The invention may also be widely used in manufacturing enameled pipes intended for any application where pipe walls in contact with aggressive media have to be given lasting and reliable anticorrosion protection.

BACKGROUND OF THE INVENTION

In industry there is an ever increasing need for pipes protected from the corrosive action of the various materials conveyed by way of pipelines.

Experience has shown that the most lasting and reliable protection is given to underground pipelines by a coating of vitreous enamels of various compositions, which are by far more durable than coatings of heated bitumen and various kinds of organic varnish and film.

To meet the stringent requirements concerning the quality of enamel coatings, such as 100 percent continuity, uniform thickness of the enamel coating, and freedom from other defects adversely affecting anticorrosion protection, it is necessary to provide equipment capable of perfectly performing the various enameling operations.

One of the enameling operations in question is application of enamel slip to the surfaces of the pipes to be enameled.

In the present art, no apparatus for applying enamel slip to a pipe surface can give the required quality of slip application, nor can they effect simultaneous application of slip to the external and internal surfaces of pipes (see, for example, U.S.S.R. Inventor's Certificate No. 204089, Int. Cl. C23d 5/00, 1965).

Known in the art is an apparatus for applying enamel slip to the internal and external surfaces of a pipe, comprising enamel slip reservoirs, a frame, and movable and stationary vises. The frame is rotatable about a horizontal axis and mounts lengthwise lead screws carrying a carriage with a ball-jointed vise. The apparatus further comprises a vertical column-type screw with a sliding nut whereon is rotatably mounted a reciprocating incomplete ring with sprayers and tracing rollers.

This apparatus suffers from the disadvantage that the tracing rollers thereof are in constant mechanical contact with the external surface of the pipe, causing damage to the coating. Another disadvantage is that the internal and external surfaces of the pipe cannot be coated simultaneously and that consumption of enamel slip is substantially large.

Also known in the art is a pipe enameling apparatus comprising an enamel slip applying device (U.S.S.R. Inventor's Certificate No. 129448, Cl. C23d 5/00, 1959). It suffers from the disadvantage that enamel slip can be applied only to the internal surface of the pipe and, furthermore, the vessel by means of which slip is fed inside the pipe dies not provide constant slip circulation, which adversely affects the adhesive properties of the slip and, consequently, the quality of the coating applied.

Also known in the art is an apparatus for applying enamel slip to the external surface of a pipe, which apparatus is constructed as a vessel filled with enamel slip and has a bottom with a seal-equipped hole through which the pipe under treatment is moved.

This apparatus suffers from the disadvantage that it applies enamel slip only to the external surface of the pipe. Another disadvantage is that there is mechanical contact between the pipe surface and the seal, which adversely affects the continuity of the coating and impairs its quality. Still another disadvantage of the apparatus under consideration is that the slip in the vessel is not agitated during the application process, which leads to separation of its colloidal structure and degradation of adhesive properties. Lastly, the apparatus does not maintain constant slip temperature, which adversely affects the physicomechanical properties of the enamel slip.

It is an object of the present invention to provide for enhancing the quality of pipe enamel coatings.

It is a further object of the present invention to solve the problem of applying enamel coatings simultaneously to the external and internal surfaces of a pipe.

It is a still further object of the present invention to decrease the amount of enamel slip consumed in the process of pipe enameling.

It is a still further object of the present invention to prolong pipe service life.

SUMMARY OF THE INVENTION

These and other objects are achieved in an apparatus for applying enamel slip to a pipe surface, comprising a housing designed to be filled with enamel slip and a mechanism for moving in that housing the pipe involved. Mounted centrally in the housing is a rod, and a clearance space to be filled with enamel slip is formed therebetween, measuring somewhat in excess of the thickness of the wall of the pipe to be moved in said clearance.

The invention provides for applying enamel slip simultaneously to the external and internal walls of a pipe of any shape (round, square, etc.), which substantially expedites the enameling process.

By obviating any mechanical contact between the elements of the apparatus and the pipe surfaces in the process of enamel slip application, the quality of the enamel coating is substantially enhanced and the service life of the pipes so enameled materially increased.

The clearance space accommodating the pipe wall just a little exceeds the pipe wall thickness, due to which the amount of the enamel slip applied is minimized and economies are effected in the prime cost of the pipes under treatment.

It is desirable that the clearance space between the housing and the rod should measure at least 1.5 times the thickness of the wall of the pipe being enameled.

Such a clearance provides for the most efficient use of enamel slip in the process of its application.

In one of the embodiment of the invention, the housing and the central rod are of cylindrical shape. This embodiment is intended for enameling round pipes, since pipes of such a shape are most widely adapted.

In another embodiment of the invention, the housing communicates via pipelines with an enamel slip circulation system. This system maintains enamel slip in a colloidal state during the application process, whereby high quality of the enamel coating is ensured.

It is further desirable that the circulation system should be provided with a reservoir having a thermoregulator. The provision of a reservoir with a thermoregulator enables the temperature of the enamel slip to be maintained within the predetermined limits during the application process, whereby the desired physicomechanical properties and the colloidal state of the enamel slip are preserved and high quality of slip application is ensured.

BRIEF DESCRIPTION OF THE DRAWING

For a better understanding of the objects and advantages of the present invention, embodiments thereof will now be described in detail with reference to the accompanying drawings, wherein.

DISCLOSURE OF BEST MODE OF THE INVENTION

Figure 1:
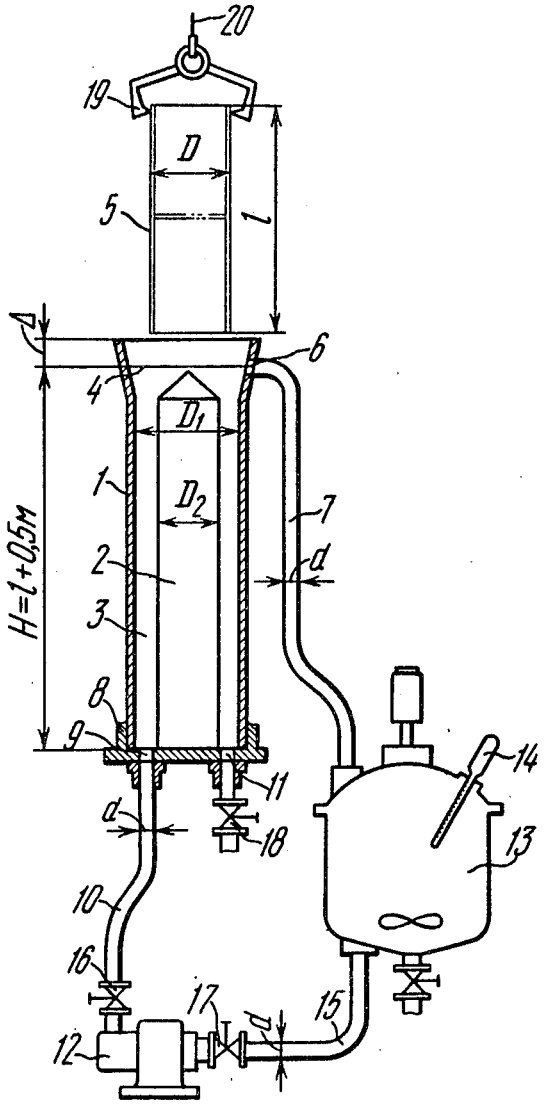
FIG. 1 is a vertical sectional view showing the general construction of the apparatus for applying enamel slip to a pipe.

The apparatus constituting the present invention comprises a vertical housing 1, wherein is centrally mounted a rod 2 so that an annular clearance space 3 to be filled with enamel slip is formed therebetween. At the top, the housing 1 has a flare 4 for accommodating the enamel slip forced out by the pipe 5 under treatment. The flare 4 has a hole 6 communicating with a return line 7. The dimension of the clearance space 3 is chosen with respect to the thickness of the wall of the pipe 5 under treatment and should be at least 1.5 times this thickness. The housing 1 and the rod 2 are installed on a common base 8 which has a hole 9 communicating with a delivery line 10 and further has a hole with a connection 11 for discharging enamel slip in flushing the apparatus. The delivery line 10 is connected to a pump 12. The return line 7 is connected to an intermediate reservoir 13 which is provided with an enamel slip agitator of the mechanical type and a temperature pickup 14 to control the temperature of the enamel slip within the predetermined limits. The intermediate reservoir 13 communicates with the pump 12 via a line 15. The lines 10 and 15 are provided with valves 16 and 17 respectively. The connection 11 is provided with a valve 18. The pump 12, the reservoir 13, and the lines 8, 10, and 15 constitute an enamel slip circulation system.

The apparatus operates as follows:

The pipe 5, after the surfaces thereof are prepared by degreasing, shot blasting and dedusting, is secured in a gripper 19 suspended by a cable 20 from the pipe moving mechanisms and is brought to the flare 4 over the rod 2. The pump 12, which is constantly in operation, delivers enamel slip into the clearance space 3. After the level of the enamel slip reaches the hole 6, the pipe 5 is lowered into the housing 1 and then raised at the appropriate speed. The enamel slip is applied simultaneously to the external and internal surfaces of the pipe 5 by the agency of surface tension. The pump 12 delivers the enamel slip from the intermediate reservoir 13 via the lines 15 and 10 into the housing 1 and thence, via the return line 7, back into the reservoir 13, wherein the enamel slip is heated to the predetermined temperature and constantly stirred by the mechanical agitator. The temperature of the enamel slip is controlled by the pickup 14 which sends appropriate pulses to an enamel slip heater (not shown) incorporated in the reservoir 13.

The following construction materials are recommended for the major elements of the apparatus indicated in FIG. 1:

The housing 1 and the rod 2 may be made of stainless steel, brass or any other material that will not be corroded by contact with the enamel slip. The same materials are recommended for the lines 7, 10 and 15.

The reservoir 13 may be constituted by a standard enameled reaction vessel fitted with a mechanical agitator, water heating jacket and conventional temperature pickups set to 20°–22° C.

The pump 12 is of the diaphragm type. Its body and parts in contact with the enamel slip may be of stainless steel or enameled for protection from the corrosive action of the slip.

Figure 2:
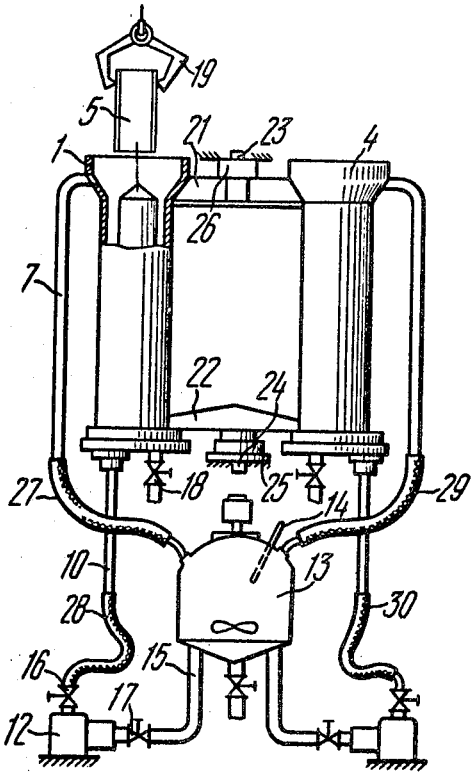
FIG. 2 shows an embodiment of the apparatus for applying enamel slip to a pipe.
Figure 3:
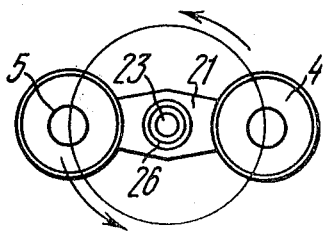
FIG. 3 is a plan view of the embodiment of FIG. 2.

FIGS. 2 and 3 show an embodiment of the apparatus for applying enamel slip to a pipe surface, wherein all the components depicted in FIG. 1 are duplicated in order that the housings 1 may be alternately flushed or repaired without stopping the process of enamel slip application. In this embodiment, the two housings 1 are rigidly interconnected by means of bars 21 and 22 having trunnions 23 and 24 mounted in bearings 25 and 26. The delivery lines 10 and the return lines 7 of the circulation system are provided with flexible insertion pieces 27, 28, 29 and 30 which enable the housings 1 to turn on the trunnions 23 and 24 through 180° with respect to each other.

The apparatus described above with reference to FIGS. 1 and 2 was tried under industrial conditions, treating a pipe of 300 mm diameter by 10 m long.

The preparation of the pipe surfaces was carried out by decreasing, shot clasting and dedusting.

An enamel slip coating of 100 percent continuity and a thickness of 120 to 140 μm was applied to the external and internal surfaces of the pipe. During application the enamel slip was at a temperature of 20°–22° C., the pipe was fed in the apparatus at a rate of 1.5–2 m/min.

After the treatment in the apparatus the coated pipe is sent first for drying and then for baking the enamel coating.

For a pipe with the above-stated measurements, the specifications for the major components of the apparatus are as follows:

| | |
|---|---|
| Housing depth | H = 10.5 |
| Housing diameter | $D_1$ = 350 mm |
| Rod diameter | $D_2$ = 250 mm |
| Line diameter | d = 100 mm |
| Amount of enamel slip in housing | V = 600 l |
| Volume of intermediate reservoir | $V_1$ = 2.5 $m^3$ |
| Pump output | Q = 6 $m^3$/h |

What is claimed is:

1. Apparatus for applying enamel slip to a walled pipe, comprising:

at least one housing designed to be filled with enamel slip;

pump means for supplying enamel slip to said housing;

a rod centrally mounted in said housing;

said housing and said rod forming therebetween a clearance space to be filled with enamel slip;

and a mechanism for moving said pipe in said clearance space.

2. An apparatus according to claim 1, wherein the housing and the rod are of cylindrical shape.

3. An apparatus according to claim 1, wherein the housing communicates with an enamel slip circulation system via pipelines.

4. An apparatus according to claim 3, wherein the enamel slip circulation system is provided with a reservoir having a thermoregulator.

5. The apparatus of claim 1, comprising a pair of interconnected housings and an enamel slip circulation system communicating with said housings.

6. The apparatus of claim 5, wherein said housings are mounted for rotation through 180 degrees with respect to each other.

7. The apparatus of claim 1, wherein said space is at least 1.5 times the thickness of the wall of the pipe to be enamelled.

* * * * *